US007741821B2

(12) United States Patent
Schlak

(10) Patent No.: US 7,741,821 B2
(45) Date of Patent: Jun. 22, 2010

(54) START-UP CIRCUIT AND METHOD FOR HIGH VOLTAGE POWER DISTRIBUTION CIRCUIT

(75) Inventor: Robert B. Schlak, Hyde Park, NY (US)

(73) Assignee: International Business Machines Corporation, Armonk, NY (US)

( * ) Notice: Subject to any disclaimer, the term of this patent is extended or adjusted under 35 U.S.C. 154(b) by 294 days.

(21) Appl. No.: 11/856,757

(22) Filed: Sep. 18, 2007

(65) Prior Publication Data

US 2009/0072808 A1 Mar. 19, 2009

(51) Int. Cl.
*G05F 1/56* (2006.01)

(52) U.S. Cl. ..... 323/272; 327/363

(58) Field of Classification Search ..... 323/281–285, 323/238, 272–277, 901; 363/16–20, 25, 363/58, 98, 49; 361/18, 93.1, 93.9, 75, 118
See application file for complete search history.

(56) References Cited

U.S. PATENT DOCUMENTS 5,861,737 A 1/1999 Goerke et al.
6,177,783 B1 * 1/2001 Donohue ..... 323/272
6,525,515 B1 2/2003 Ngo et al.
6,590,439 B1 * 7/2003 Larson ..... 327/363
2004/0145273 A1 7/2004 Khoury et al.
2007/0253223 A1 * 11/2007 Neidorff et al. ..... 363/2

OTHER PUBLICATIONS

US 6,034,516, 03/2000, Goerke et al. (withdrawn)

* cited by examiner

*Primary Examiner*—Rajnikant B Patel
(74) *Attorney, Agent, or Firm*—Cantor Colburn LLP; Geraldine Monteleone

(57) ABSTRACT

A start-up circuit for a high voltage power distribution circuit includes a transistor, a current source which generates ramped current, an operational amplifier which is connected between the current source and the transistor and controls the transistor, a capacitor which is fed the generated ramped current from the current source and is charged by the generated ramped current, the capacitor being connected to the non-inverting input of the operational amplifier, and a feedback capacitor connected from the transistor output to the non-inverting input of the operational amplifier, which is fed the generated ramped current from the capacitor and is discharged. The transistor is fully enabled when the feedback capacitor is fully discharged.

8 Claims, 4 Drawing Sheets

START-UP CIRCUIT AND METHOD FOR HIGH VOLTAGE POWER DISTRIBUTION CIRCUIT

BACKGROUND OF THE INVENTION

1. Field of the Invention

This invention relates generally to high voltage power distribution circuits in high density server power systems, and more particularly, to a start-up circuit and method for a high voltage power distribution circuit which improve the start-up of a metal-oxide-semiconductor field-effect transistor (MOSFET) into a capacitive load.

2. Description of Background

In high-density server power systems, for example, high voltage DC power distribution is controlled with electronic switches (e.g., MOSFETs) to isolate load faults and to provide desired system availability. Since loads of the MOSFET circuits are capacitive, high power dissipation occurs when the MOSFET is first enabled. Thus, using conventional methods, there is a continuous problem with the reliability of the MOSFET.

Generally, server power systems employ a conventional method for reducing power dissipation by stretching the start-up time (i.e., a soft start-up operation) of the high voltage power distribution circuit. Using this conventional method, stretching the start-up time results in decreasing the peak current which in turn decreases current accuracy and makes protecting the MOSFET more difficult. In addition, load circuits may not function properly, system timings are required to be altered, and power-on durations increase as a result of the longer start-up time. Further, when using this conventional start-up method, an initial peak MOSFET power spike is still present even though it is reduced in magnitude.

In the conventional start-up method for a high voltage power distribution circuit as mentioned above, a current source generates constant current which discharges a feedback capacitor of the circuit. The constant current is approximated by connecting a resistor to a 350V (for example) voltage source. The generated constant current first charges up a capacitor, which is connected with a non-inverting input of an operational amplifier connected between a MOSFET and the current source, until the non-inverting input of the operational amplifier is approximately at a gate threshold for the MOSFET. Upon starting up the MOSFET, the constant current has completely charged the capacitor and the current is then fed into the feedback capacitor discharging a voltage charge on the feedback capacitor. As shown in FIG. 1, the constant current forces the load voltage to increase linearly from zero to approximately 350V and the power generated inside the MOSFET is over approximately 300 W at start-up, thereby damaging the MOSFET when powering on the circuit. As illustrated, when employing this conventional start-up method, increasing the start-up time, for example, to above approximately 60 ms lowers the discharge current which in turn lowers the peak power of the MOSFET.

Accordingly, it would be desirable to have start-up circuit and method for controlling start-up of a high voltage power distribution circuit capable of reducing power dissipation upon start-up, while maintaining MOSFET reliability.

SUMMARY OF THE INVENTION

The shortcomings of the prior art are overcome and additional advantages are provided through the provision of a start-up circuit for a high voltage power distribution circuit having the capability of reducing power dissipation upon start-up, wherein the start-up circuit includes a transistor, a current source which generates ramped current, an operational amplifier which is connected between the current source and the transistor and controls the transistor, a capacitor which is fed the generated ramped current from the current source and is charged by the generated ramped current, the capacitor being connected to the non-inverting input of the operational amplifier, and a feedback capacitor connected from the transistor output to the non-inverting input of the operational amplifier, which is fed the generated ramped current from the capacitor and is discharged. The transistor is fully enabled when the feedback capacitor is fully discharged.

A further aspect of the present invention relates to a start-up method for controlling start-up of a high voltage power distribution circuit, the start-up method including generating ramped current via a current source, feeding the generated ramped current to a capacitor which is connected to the non-inverting input of an operational amplifier connected between the current source and a MOSFET, and charging the capacitor, feeding the generated ramped current from the capacitor to a feedback capacitor connected from the MOSFET output to the non-inverting input of the operational amplifier, discharging the feedback capacitor, and enabling the MOSFET when the feedback capacitor is fully discharged.

A computer program product corresponding to the above-summarized method is also described and claimed herein.

Additional features and advantages are realized through the techniques of the present invention. Other embodiments and aspects of the invention are described in detail herein and are considered a part of the claimed invention. For a better understanding of the invention with advantages and features, refer to the description and to the drawings.

Technical Effects

As a result of the summarized invention, technically we have achieved a solution which increases the reliability of the MOSFET at start-up and allows a wider selection of MOSFETs to be used. Alternately, the circuit may tolerate higher capacitive loads without increasing MOSFET stress.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF THE INVENTION

Figure 2:
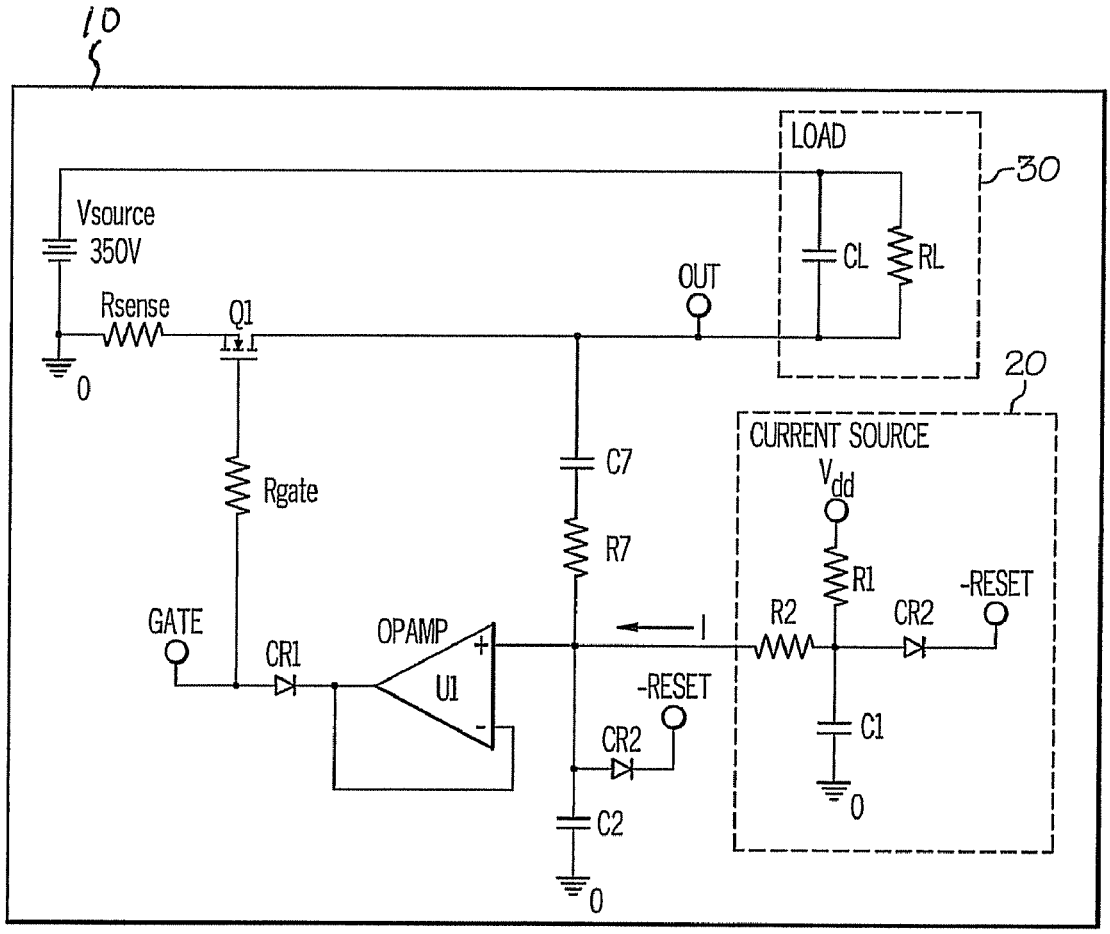
FIG. 2 is a schematic diagram illustrating one example of aspects of a start-up circuit that can be implemented within embodiments of the present invention.

Turning now to the drawings in greater detail, it will be seen that in FIG. 2 there is a circuit schematic illustrating a start-up circuit for a high voltage power distribution circuit according to one embodiment of the present invention.

As shown in FIG. 2, a start-up circuit 10 comprises a transistor Q1, a 350V DC voltage source (Vsource), a current source 20, and a load 30. The current source 20 includes a dual diode CR2, a voltage Vdd, a capacitor C1 and resistors R1 and R2. Prior to starting up the circuit, the transistor Q1 is initially in an OFF state, and a –RESET signal is set low. When starting up the circuit, the –RESET signal goes from a low state to a high state, the resistor R1 charges up the capacitor C1 with RC ramp characteristics. As the voltage across the capacitor C1 rises, the resistor R2 of the current source 20 provides ramped current (I) with desired characteristics and the ramped current (I) is generated from the current source 20. The start-up circuit 10 further comprises an operational amplifier U1 which is connected between the current source 20 and the transistor Q1 and controls the transistor Q1. The operational amplifier U1 is a voltage follower acting as a buffer and completes a feedback loop which controls the gate of the transistor Q1. As shown in FIG. 2, the start-up circuit further comprises a capacitor C2 which stabilizes the circuit, the capacitor C2 connected to a non-inverting input (+) of the operational amplifier U1. The capacitor C1 is larger than the capacitor C2 in order to maintain the ramp characteristics. The capacitor C2 is fed the generated ramped current (I) from the current source 20 and is charged by the generated ramped current (I).

Further, a feedback capacitor C7 is connected from the transistor Q1 output to the non-inverting input of the operational amplifier U1. Once the capacitor C2 is charged to approximately the MOSFET gate threshold, the generated ramped current (I) is fed to the feedback capacitor C7 and the feedback capacitor C7 is discharged. The discharging of the feedback capacitor C7 forces the operational amplifier U1 to control the transistor Q1 to enabled. The transistor Q1 is fully enabled when the feedback capacitor C7 is fully discharged. That is, the ramped current (I) discharges the feedback capacitor C7 until the voltage across the feedback capacitor C7 is equal to zero and then the transistor Q1 is fully enabled.

The startup circuit further comprises a resistor R7 connected in series with the feedback capacitor C7. Although, the resistor R7 is not required during start-up of the circuit, the resistor R7 handles high voltages when the transistor Q1 is disabled. According to an embodiment of the present invention, both the feedback capacitor C7 and the resistor R7 are high voltage components, for example, 500V.

According to an embodiment of the present invention, the transistor Q1 is a metal-oxide-semiconductor field-effect transistor (MOSFET). Hereinafter, the transistor Q1 is referred to as MOSFET Q1 for purpose of illustration.

The operational amplifier U1 comprises an output connected with a gate of the MOSFET Q1 and buffers the gate and controls the MOSFET Q1 such that an output voltage decreases along with a voltage across the feedback capacitor C7.

According to an embodiment of the present invention, the feedback capacitor C7 is a negative-positive zero (NP0) dielectric ceramic capacitor.

According to an embodiment of the present invention, the capacitance of the capacitor C2 is greater than the capacitance of the feedback capacitor C7.

The capacitor C2 is connected with a dual diode CR2 such that the voltage thereof is clamped, to thereby be maintained within an input range of the operational amplifier U1.

According to an embodiment of the present invention, the current source 20 generates the ramped current (I) at a delayed rate such that the ramped current (I) remains ramped when fed into the capacitor C2 and then into the feedback capacitor C7.

The capacitor C2 charges up to approximately a gate voltage of the MOSFET Q1 before the generated ramped current (I) is fed into the feedback capacitor C7.

According to an embodiment of the present invention, when the current source 20 generates ramped current (I), as a result, a load voltage (OUT) increases exponentially along with the generated ramped current (I), and the power of the MOSFET Q1 decreases. The load voltage (OUT) is applied to load 30.

Figure 3:
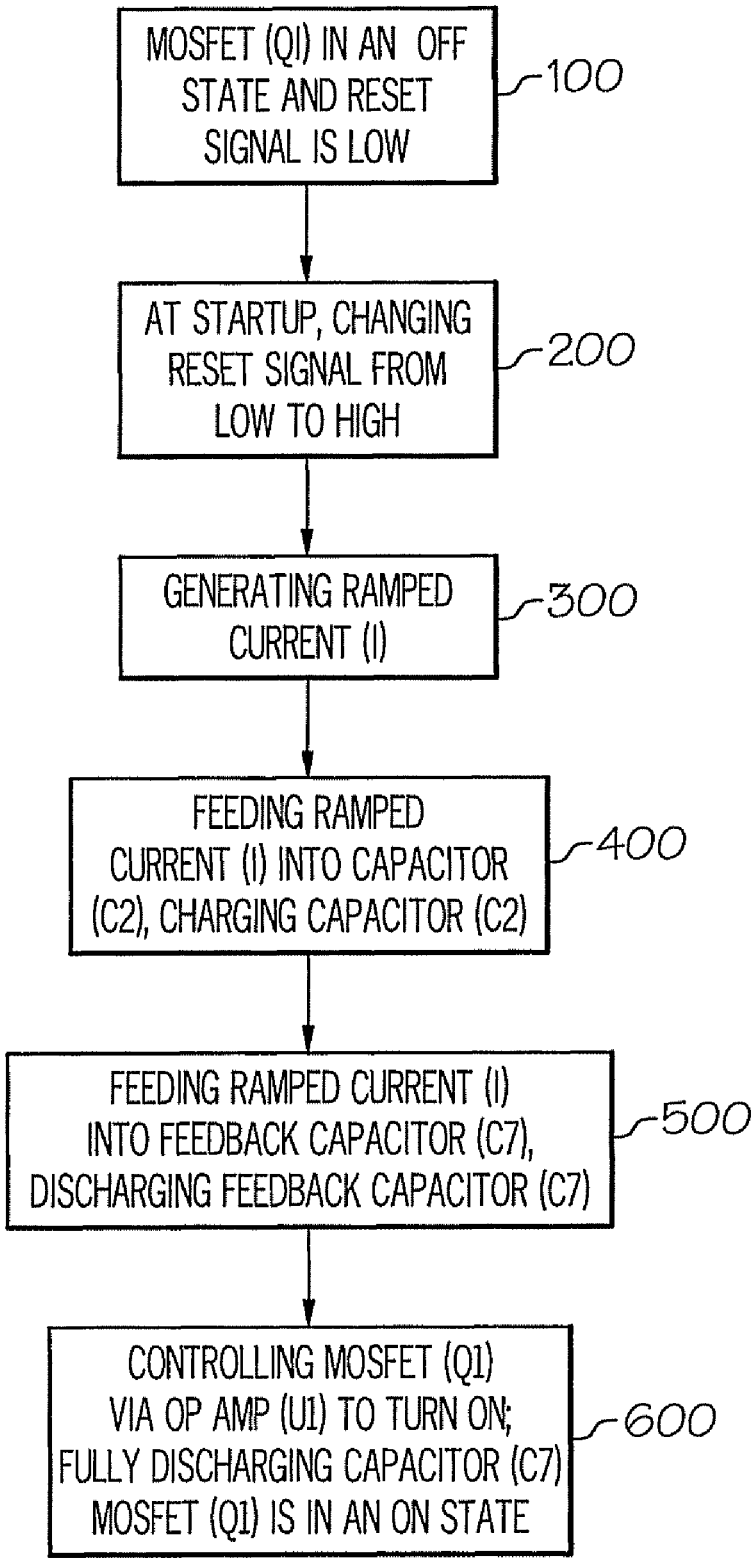
FIG. 3 illustrates a flow chart detailing aspects of a start-up method for a high voltage power distribution circuit that can be implemented within aspects of the present invention.

FIG. 3 illustrates a flow chart detailing aspects of a start-up method for a high voltage power distribution circuit that can be implemented within aspects of the present invention.

As shown in FIG. 3, prior to start-up, at operation 100, the MOSFET is in an OFF state and a RESET signal is set low. From operation 100, the process moves to operation 200, where the RESET signal is switched from a low state to a high state.

From operation 200, the process moves to operation 300, where ramped current is generated by the current source 20. From operation 300, the process to moves to operation 400, where the ramped current is fed into the capacitor C2 which is connected to the non-inverting input of the operational amplifier U1 connected between the current source 20 and a MOSFET Q1, and charges the capacitor C2.

From operation 400, the process moves to operation 500, where the capacitor C2 has been charged to approximately the MOSFET Q1 gate threshold and the generated ramped current is fed to the feedback capacitor C7 connected from the MOSFET Q1 output to the non-inverting input of the operational amplifier U1.

From operation 500, the process moves to operation 600, where the feedback capacitor C7 is discharged thereby forcing the operational amplifier U1 to control the MOSFET Q1 to be turned on, such that the MOSFET Q1 is in an ON state upon fully discharging the feedback capacitor C7.

Figure 4:
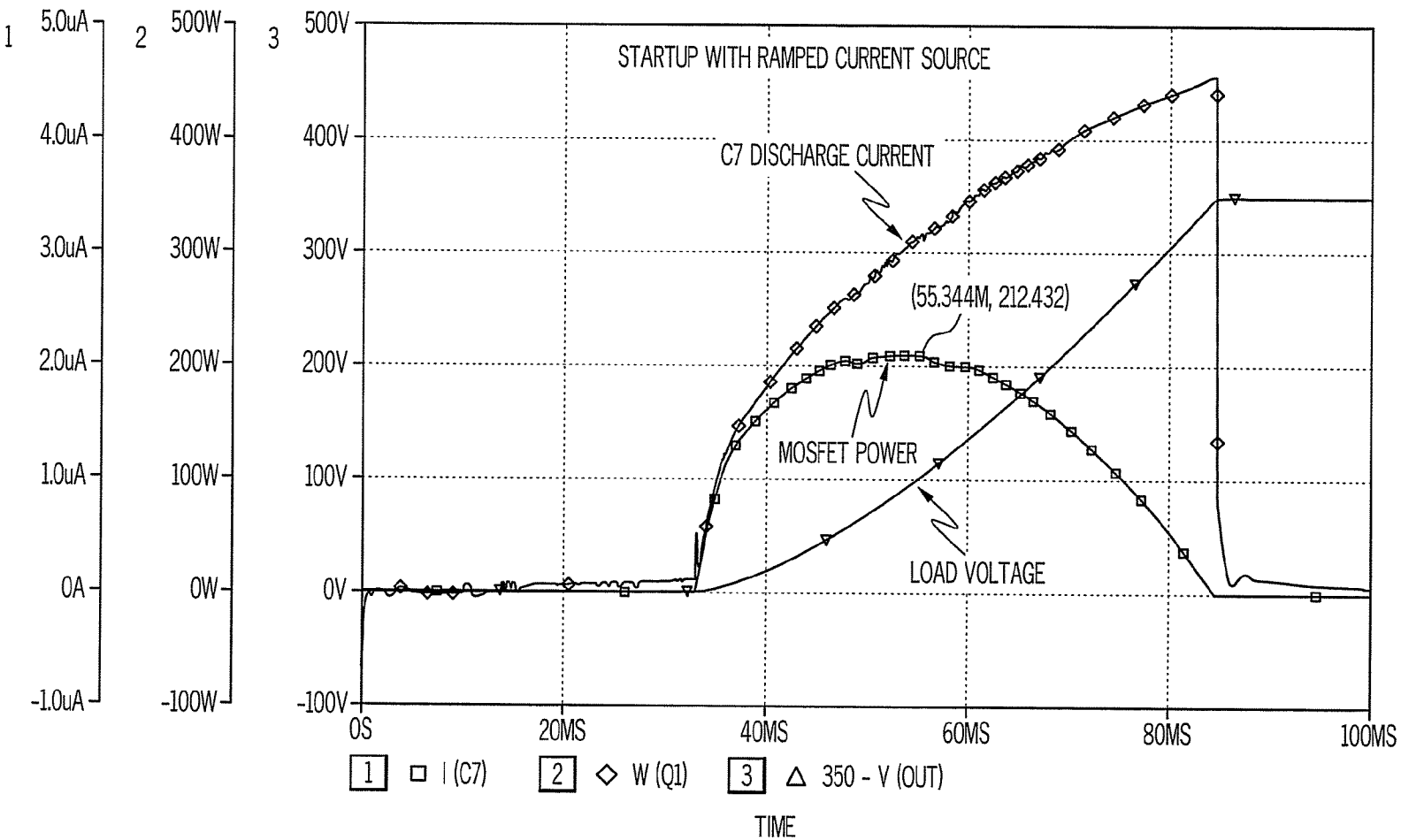
FIG. 4 is a graph illustrating an example of aspects of the relationship between discharge current, MOSFET power and load voltage when the MOSFET is first enabled, referencing the start-up circuit as shown in FIG. 2 and the flow chart as shown in FIG. 3, according to an embodiment of the present invention.

FIG. 4 is a graph illustrating an example of aspects of the relationship between discharge current, MOSFET power and load voltage when the MOSFET is first enabled, referencing the start-up circuit as shown in FIG. 2 and the flow chart as shown in FIG. 3, according to an embodiment of the present invention.

Figure 1:
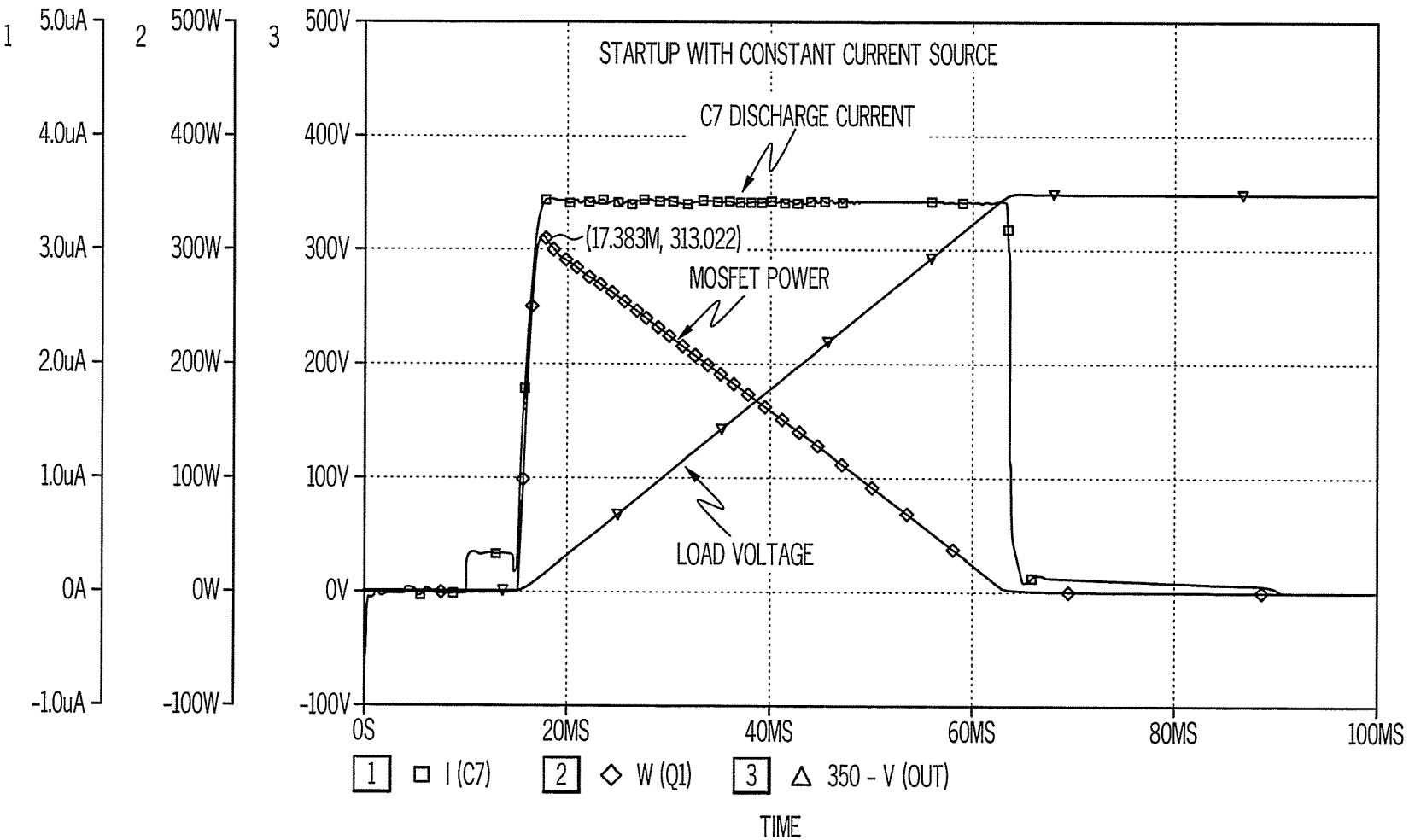
FIG. 1 (PRIOR ART)
FIG. 1 is a graph illustrating the relationship between discharge current, MOSFET power and load voltage during a conventional start-up method for a high voltage power distribution circuit when a MOSFET is first enabled.

As shown in FIG. 4, by generating ramped current, the load voltage increases exponentially as the discharge current increases and the MOSFET power decreases. As shown in FIG. 4, although there are 350 volts across the MOSFET Q1 at the beginning of turning on the MOSFET Q1, the current is approximately zero amps. The MOSFET power as shown in FIG. 4 is reduced by approximately 100 W in comparison to the MOSFET power shown in FIG. 1.

The capabilities of the present invention can be implemented in software, firmware, hardware or some combination thereof.

As one example, one or more aspects of the present invention can be included in an article of manufacture (e.g., one or more computer program products) having, for instance, computer usable media. The media has embodied therein, for instance, computer readable program code means for providing and facilitating the capabilities of the present invention. The article of manufacture can be included as a part of a computer system or sold separately.

Additionally, at least one program storage device readable by a machine, tangibly embodying at least one program of instructions executable by the machine to perform the capabilities of the present invention can be provided.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A start-up circuit for a high voltage power distribution circuit, comprising:

a transistor;

a current source which generates ramped current;

an operational amplifier which is connected between the current source and the transistor and controls the transistor;

a first capacitor which is fed the generated ramped current from the current source and is charged by the generated ramped current, the first capacitor being connected with a non-inverting input of the operational amplifier; and a second capacitor connected from an output of the transistor to the non-inverting input of the operational amplifier, the second capacitor comprising a feedback capacitor which is fed the generated ramped current and is discharged such that the transistor is fully enabled when the feedback capacitor is fully discharged, wherein the feedback capacitor is a negative-positive zero (NP0) dielectric ceramic capacitor.

2. The start-up circuit of claim 1 wherein the transistor is a metal-oxide-semiconductor field-effect transistor (MOSFET).

3. The start-up circuit of claim 2, wherein an output of the operational amplifier is connected to a gate of the MOSFET and buffers the gate and controls the MOSFET such that an output voltage decreases along with a voltage across the feedback capacitor.

4. A start-up circuit for a high voltage power distribution circuit, comprising:

a transistor;

a current source which generates ramped current;

an operational amplifier which is connected between the current source and the transistor and controls the transistor;

a first capacitor which is fed the generated ramped current from the current source and is charged by the generated ramped current, the first capacitor being connected with a non-inverting input of the operational amplifier; and a second capacitor connected from an output of the transistor to the non-inverting input of the operational amplifier, the second capacitor comprising a feedback capacitor which is fed the generated ramped current and is discharged such that the transistor is fully enabled when the feedback capacitor is fully discharged, wherein a capacitance of the first capacitor is greater than a capacitance of the feedback capacitor.

5. A start-up circuit for a high voltage power distribution circuit, comprising:

a transistor;

a current source which generates ramped current;

an operational amplifier which is connected between the current source and the transistor and controls the transistor;

a first capacitor which is fed the generated ramped current from the current source and is charged by the generated ramped current, the first capacitor being connected with a non-inverting input of the operational amplifier; and a second capacitor connected from an output of the transistor to the non-inverting input of the operational amplifier, the second capacitor comprising a feedback capacitor which is fed the generated ramped current and is discharged such that the transistor is fully enabled when the feedback capacitor is fully discharged, wherein the first capacitor is connected with a dual diode and a voltage thereof is clamped to thereby be maintained within an input range of the operational amplifier.

6. A start-up circuit for a high voltage power distribution circuit, comprising:

a transistor;

a current source which generates ramped current;

an operational amplifier which is connected between the current source and the transistor and controls the transistor;

a first capacitor which is fed the generated ramped current from the current source and is charged by the generated ramped current, the first capacitor being connected with a non-inverting input of the operational amplifier; and a second capacitor connected from an output of the transistor to the non-inverting input of the operation amplifier, the second capacitor comprising a feedback capacitor which is fed the generated ramped current and is discharged such that the transistor is fully enabled when the feedback capacitor is fully discharged, wherein the current source generates the ramped current at a delayed rate such that the ramped current remains ramped when fed into the first capacitor and then into the feedback capacitor.

7. The start-up circuit of claim 1, wherein the first capacitor charges up to approximately a gate voltage of the transistor before the generated ramped current is fed through the feedback capacitor.

8. The start-up circuit of claim 1, wherein when the current source generates ramped current, a load voltage increases exponentially along with the generated ramped current, and power in the transistor decreases.

* * * * *